United States Patent [19]

Lorant

[11] Patent Number: 4,478,042

[45] Date of Patent: Oct. 23, 1984

[54] CYLINDER LINER-REGENERATOR UNIT FOR A HOT GAS ENGINE

[75] Inventor: Stefan Lorant, Oxie, Sweden

[73] Assignee: United Stirling AB, Malmo, Sweden

[21] Appl. No.: 437,849

[22] Filed: Oct. 29, 1982

[51] Int. Cl.[3] ..... F02G 1/04

[52] U.S. Cl. ..... 60/526; 60/517

[58] Field of Search ..... 60/517, 525, 526; 62/6

[56] References Cited

U.S. PATENT DOCUMENTS 2,616,246 11/1952 Van Weenen ..... 60/526
3,861,146 1/1975 Lynch et al. ..... 60/526 X
4,050,250 9/1977 Davis ..... 60/517
4,174,616 11/1979 Nederlof et al. ..... 60/517

*Primary Examiner*—Stephen F. Husar
*Attorney, Agent, or Firm*—Finnegan, Henderson, Farabow, Garrett & Dunner

[57] ABSTRACT

In a hot gas engine of the type having a regenerator surrounding each cylinder top a part of the upper cylinder wall and the regenerator have been made as a unit having low heat conductivity in axial and radial directions, the unit consisting of two interconnected wall elements leaving a gap of ring shaped cross section between them, and the regenerator being brazed to the outside of the outer wall element.

8 Claims, 2 Drawing Figures

CYLINDER LINER-REGENERATOR UNIT FOR A HOT GAS ENGINE

BACKGROUND OF THE INVENTION

1. Field of the Invention

The present invention relates to a cylinder liner-regenerator unit for a hot gas engine of the type in which each cylinder is surrounded by a regenerator having ring shaped cross section and adapted to abut a gas cooler also having ring shaped cross section.

2. Description of the Prior Art

It is well known in the art that the efficiency of a hot gas engine depends on moving a working gas charge between two variable volume chambers kept at temperature levels which differ as must as practically possible. At present the high level is often more than 700° C. and the low level around 70° C. However, any heat flow between said two chambers e.g. due to the conductivity of the engine elements will cause a loss of energy and thus a lower efficiency of the engine. Certainly a greater difference between the two temperature levels will have the advantage of increasing the thermal efficiency, but it will also increase the loss of energy caused by heat conduction.

SUMMARY OF THE INVENTION

The object of the invention is to provide a cylinder liner-regenerator unit having a minimum of heat conductivity in radial and axial directions and which is reliable as a machine element in the engine. According to the present invention this is obtained thereby that said unit comprises two cylindrical wall elements of substantially equal length and interconnected near their ends, said elements being coaxially arranged and spaced from each other so as to leave a gap between them, the outer one of said wall elements being fitted with a surrounding regenerator having an axial length which is substantially shorter than the axial extension of said gap.

DESCRIPTION OF THE PREFERRED EMBODIMENT

Figure 1:
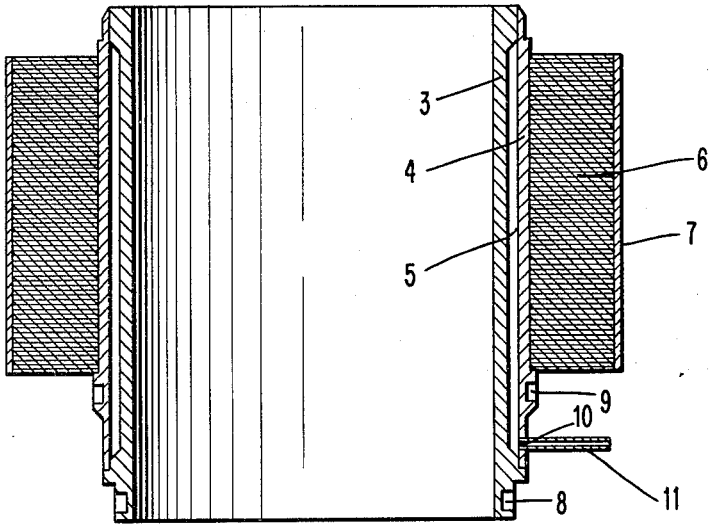
FIG. 1 is an axial section of a unit according to the invention.

Reference will now be made to the preferred embodiment of the invention shown in the drawing.

The hot gas engine in which the unit according to the invention is mounted may e.g. be of the double-acting type. Such engine is shown e.g. in the U.S. patent application No. 292,704 now U.S. Pat. No. 4,417,443. The interior of each engine cylinder is divided into two variable volume chambers by a movable piston 1, the top of which is shown in dash-dotted lines in FIG. 2. The piston 1 is shown in its extreme upper position in which the upper variable volume chamber 2 has its minimum volume.

The unit according to the invention consists of a cylinder liner axial segment having an inner cylindrical wall element 3 connected to an outer cylindrical wall element 4 by vacuum brazing. The two wall parts 3 and 4 are made of heat resistant stainless steel e.g. of a type containing 25 percent chromium.

The wall element 3 is about 3 mm thick and has a diameter of 85 mm and a length of 115 mm. The wall element 4 is slightly thinner i.e. about 2.5 mm thickness and there is a gap 5 of 2 mm between the two wall elements 3 and 4.

A regenerator 6 surrounding the upper part of the wall element 4 consists of a great number of ring shaped stampings of wire mesh stacked together and surrounded by a shroud 7 of stainless steel. The wires of the regenerator are also of stainless steel—preferably the common type containing 18% Cr and 8% Ni.

The regenerator 6 is of conventional design but has been vacuum brazed to the wall element 4 preferably during the brazing of the elements 3 and 4.

It should be noted that the gap 5 extends further downwardly than the regenerator 6.

The wall element 3 has been provided with a groove 8 adapted to receive an O-ring seal element and the wall element 4 is provided with a similar groove 9.

The outer wall element 4 is provided with a bore 10 in which a tube 11 is inserted connecting the interior of the gap 5 with the atmosphere.

Figure 2:
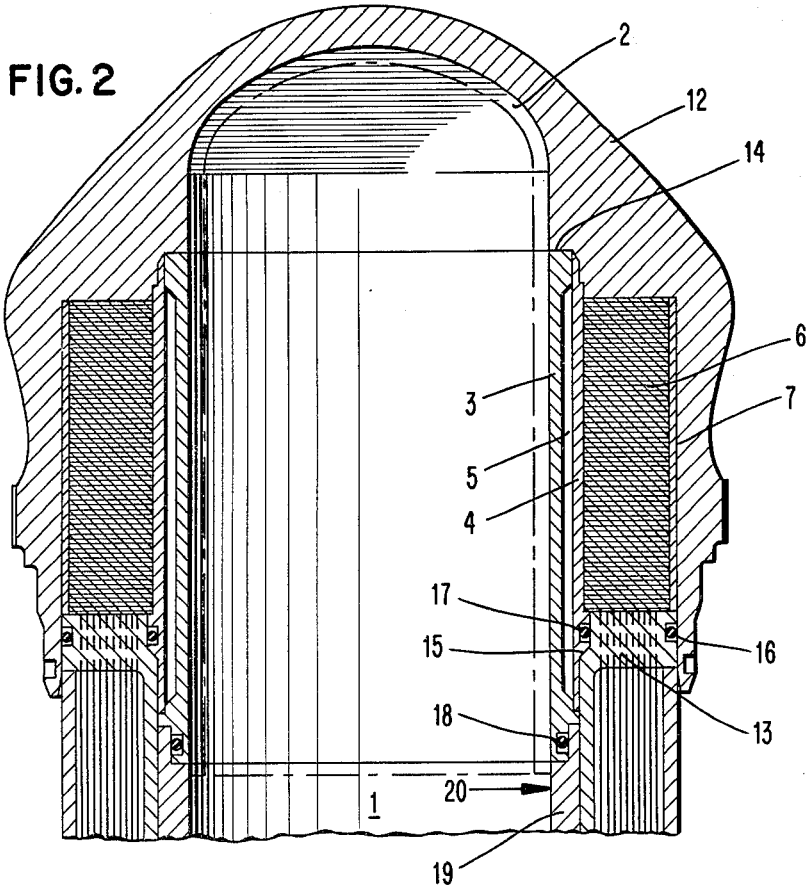
FIG. 2 is an axial section of a part of a hot gas engine in which the unit shown in FIG. 1 has been mounted.

FIG. 2 shows how the unit of FIG. 1 has been mounted between a cylinder top 12 and a cooler 13. Shoulder surfaces 14 and 15 are engaged and O-rings 16, 17 and 18 provides gas tight seals. The O-ring 18 forms a seal between the lower part of the wall element 3 and a cylinder liner 19.

The piston 1 is provided with piston rings (not shown) sliding against the cylinder liner 19. The uppermost position of the upper piston ring has been indicated by an arrow 20 in FIG. 2.

The device described and shown will operate as follows:

The variable volume chambers of the engine, the interior of the regenerator 6 and the cooler 13 as well as gas connections not shown—e.g. between the variable volume chamber 2 and the regenerator 6, all contain a working gas under high pressure—e.g. a mean pressure of 15 MPa. The temperature of the gas in the chamber 2 and in the upper part of the regenerator 6 may be higher than 700° C.

In case the engine is adapted to use helium as the working gas (which it may be in case of a rather slow running engine) the vent opening 10, 11 will be omitted. The gap 5 will then be completely evacuated during the brazing of the unit which is performed under vacuum. However, after having run the engine for some time the high temperature, the high pressure of the gas, the small molecules of the gas and the rather thin wall element 3 will cause helium to enter into the gap which will become filled with helium under pressure. However, helium is not a good heat conductor and the gap will act as insulating means preventing any substantial flow of heat radially outwards. The thin wall element 3 prevents greater heat flow axially downwards.

The temperature of the wall element 3 is about 700° C. at its top and less than 200° C. at its bottom. The temperature of the regenerator is 700° C. at its top and less than 100° C. at its bottom.

It will be understood that all elements shown are exposed to heavy stresses due to variations in temperature during starting up and cooling off of the engine. The O-rings 16, 17 and 18 are located close to cooling water channels and thus the temperature of the O-rings may easily be kept below the limit of about 250° C. set for their proper use. It will be observed that the contact surfaces between the wall element 3 and the cooler 13 or the liner 19 may be very small thus further limiting the axial downward flow of heat.

If the working gas used consists of hydrogen the vent opening 10 and the tube 11 should be retained. Hydrogen—which is a very good heat conductor—will then pass to the atmosphere—at an extremely low rate which is without importance e.g. from a safety point of view.

I claim:

1. A cylinder liner-regenerator unit for a hot gas engine of the type in which each cylinder is surrounded by a regenerator having a ring shaped cross section said regenerator being adapted to axially abut a gas cooler also having a ring shaped cross section and surrounding the respective cylinder, characterised in that said unit comprises a cylinder liner axial segment having two cylindrical wall elements of substantially equal length and interconnected near their ends, said elements being coaxially arranged and spaced from each other so as to leave a gap between them, the outer one of said wall elements being radially adjacent a surrounding regenerator having an axial length which is substantially shorter than the axial extension of said gap.

2. The unit according to claim 1, characterised in that the said outer wall element is provided with an opening venting said gap to the atmosphere.

3. The unit according to claim 1 or 2, characterised in that said two walls are interconnected by vacuum brazing.

4. The unit according to claim 1 or 2 wherein said outer wall is attached to said surrounding regenerator.

5. The unit according to claim 4 wherein said outer wall is attached to said surrounding regenerator by vacuum brazing.

6. The unit according to claim 1 further comprising means formed in said inner wall element near an end for sealingly engaging another liner axial segment.

7. The unit according to claim 1 further comprising means formed in said outer wall element for sealingly engaging said gas cooler.

8. The unit according to claim 6 or 7 wherein said sealingly engaging means includes an abutting shoulder and an adjacent o-ring groove formed in the respective wall.

* * * * *